US007625327B1

(12) United States Patent
Teeter et al.

(10) Patent No.: US 7,625,327 B1
(45) Date of Patent: Dec. 1, 2009

(54) ADJUSTABLE TILTING INVERSION EXERCISER

(76) Inventors: Roger C. Teeter, 20720 Snag Island, Sumner, WA (US) 98390; Lopin Wang, 16F-2, No. 62, Sec. 2, Chnoder 2Nd, Beitun Chu, Taichung 40652 (TW) 40652

( * ) Notice: Subject to any disclaimer, the term of this patent is extended or adjusted under 35 U.S.C. 154(b) by 138 days.

(21) Appl. No.: 12/290,301

(22) Filed: Oct. 29, 2008

(51) Int. Cl.
*A63B 26/00* (2006.01)

(52) U.S. Cl. ..... 482/144; 601/23

(58) Field of Classification Search ..... 482/143–145; 601/1, 23–26; 128/845
See application file for complete search history.

(56) References Cited

U.S. PATENT DOCUMENTS 5,967,956 A 10/1999 Teeter ..... 482/144
6,814,691 B1 11/2004 Kuo ..... 482/145
7,112,167 B2 9/2006 Kim ..... 482/145
7,125,372 B1 10/2006 Teeter et al. ..... 482/144

*Primary Examiner*—Lori Amerson
(74) *Attorney, Agent, or Firm*—Charles E. Baxley

(57) ABSTRACT

A tilting inversion exerciser includes a carrier having two arms pivotally attached to two apex members of a supporting stand and having a bar, a user supporting table adjustably secured to the bar of the carrier for adjusting toward and away from the bar of the carrier and for suitably or adjustably supporting the users of different weights or body forms or physiques, and a latching device secures the user supporting table to the bar of the carrier after the user supporting table has been adjusted relative to the bar of the carrier for suitably adjusting the user supporting table and the user toward and away from the apex members or the center of gravity of the supporting stand.

6 Claims, 6 Drawing Sheets

ADJUSTABLE TILTING INVERSION EXERCISER

BACKGROUND OF THE INVENTION

1. Field of the Invention

The present invention relates to a tilting inversion exerciser, and more particularly to an adjustable tilting inversion exerciser having a user supporting table pivotally or rotatably attached to a supporting stand with a pivot axle and movable or adjustable relative to the pivot axle of the supporting stand for suitably or adjustably supporting the users of different weights or body forms or physiques.

2. Description of the Prior Art

Typical tilting inversion exercisers comprise a base or table pivotally or rotatably supported on a lower support stand, for supporting a user thereon, and for allowing the user to tilt or to incline the table relative to the lower support, in order to conduct the typical tilting inversion exercises.

For example, U.S. Pat. No. 5,967,956 to Teeter discloses one of the typical rotatable or tilting inversion exercisers comprising a stationary support stand composed of spaced A-frames having spaced trunnion supporting bearing plates and hanger bars for supporting a user supporting table and for allowing the user supporting table to be pivoted or rotated relative to the stationary support stand.

However, the coupling mechanism between the user supporting table and the hanger bars is weak and may not stably support the user on the user supporting table, or the user supporting table may have a good chance to be twisted relative to the hanger bars of the stationary support stand particularly when the user supporting table supports the users of greater weights or body forms or physiques.

U.S. Pat. No. 6,814,691 to Kuo discloses another typical rotatable or tilting inversion exerciser also comprising a user supporting table pivotally or rotatably attached or secured to the stationary support stand with hanger bars.

However, similarly, the coupling mechanism between the user supporting table and the hanger bars is weak and may not stably support the user on the user supporting table, or the user supporting table may have a good chance to be twisted relative to the hanger bars of the stationary support stand particularly when the user supporting table supports the users of greater weights or body forms or physiques.

U.S. Pat. No. 7,112,167 to Kim discloses a further typical rotatable or tilting inversion exerciser comprising a user supporting table pivotally or rotatably attached or secured to a stationary support stand, and one or more motors attached to the stationary support stand and coupled to the user supporting table for driving or rotating or tilting the user supporting table relative to the lower support stand.

However, the user supporting table may not be adjusted relative to the lower support stand to different positions for suitably or adjustably supporting the users of different weights or body forms or physiques.

U.S. Pat. No. 7,125,372 to Teeter et al. discloses a still further typical electric exerciser machine for tilting and inverting human body also comprising a rotatable frame pivotally or rotatably attached to top and supported on a lower support member with a pivoting tube, and a driving device mounted on the support member and having an electric motor for driving or rotating or tilting the rotatable frame relative to the lower support member.

However, similarly, the rotatable frame also may not be adjusted relative to the lower support member to different positions for suitably or adjustably supporting the users of different weights or body forms or physiques.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a user supporting table pivotally or rotatably attached to a supporting stand with a pivot axle and movable or adjustable relative to the pivot axle of the supporting stand for suitably or adjustably supporting the users of different weights or body forms or physiques.

In accordance with one aspect of the invention, there is provided a tilting inversion exerciser comprising a supporting stand including two apex members, a carrier including two arms each having a first end pivotally attached to the apex member and each having a second end, and a bar secured to the second ends of the arms for forming a space between the arms and the bar, a user supporting table slidably received in the space of the carrier and adjustably secured to the bar of the carrier for adjusting the user supporting table toward and away from the bar of the carrier, and a latching device securing the user supporting table to the bar of the carrier after the user supporting table has been adjusted relative to the bar of the carrier.

A motor may further be provided and attached to the apex member of the supporting stand and coupled to the first end of the arm for driving and rotating the carrier and the user supporting table relative to the supporting stand.

A reduction gearing may further be provided and coupled between the motor and the first end of the arm. The first ends of the arms are each pivotally attached to the apex members with a pivot axle.

The carrier includes at least one tubular member extended from the bar, and the user supporting table includes a pole extended downwardly from a bottom portion of the user supporting table for guiding the user supporting table to move and to adjust relative to the carrier.

The carrier includes a sleeve extended from the tubular member, and having a bore formed in the sleeve for slidably receiving the latching device.

The latching device includes a latch member slidably engaged in the bore of the sleeve and having an actuating end engaged with the pole for adjustably securing the pole to the tubular member of the carrier. The pole includes a number of orifices formed therein for selectively and adjustably engaging with the actuating end of the latch member.

The latch member includes a peripheral stop extended radially and outwardly therefrom for engaging with the tubular member and for limiting the latch member to slide relative to the tubular member and the carrier.

The latching device includes a spring member engaged with the latch member for biasing the actuating end of the latch member to engage with the pole.

The latching device includes a cap attached to the sleeve and engaged with the spring member for retaining the spring member and the latch member in the sleeve and for preventing the spring member and the latch member from being disengaged from the sleeve.

The latch device includes a knob attached to the latch member for pulling the latch member against the spring member and for selectively disengaging the actuating end of the latch member from the pole and for allowing the pole and the user supporting table to be adjusted relative to the tubular member and the bar of the carrier.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
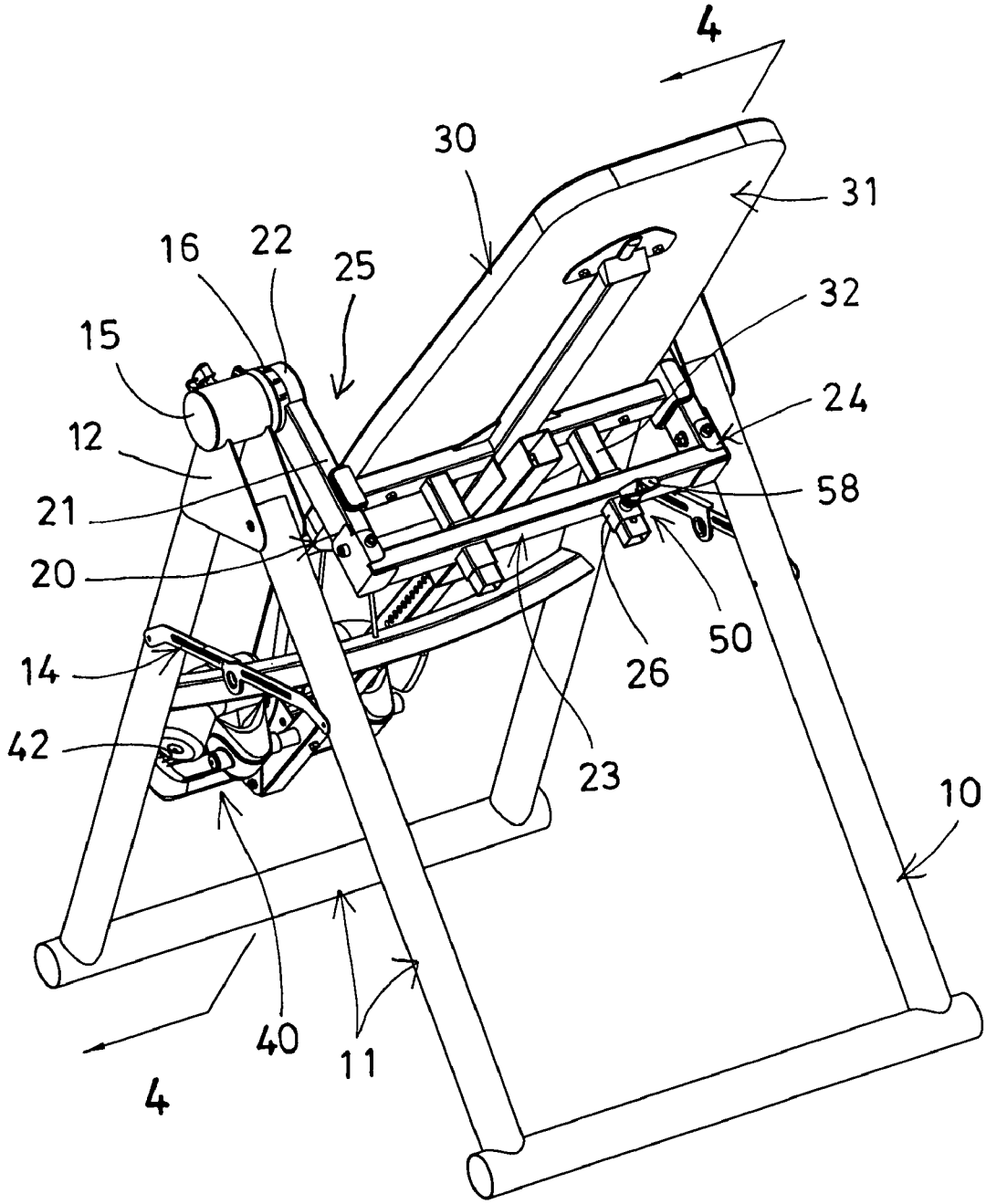
FIG. 1 is a perspective view of a tilting inversion exerciser in accordance with the present invention.
Figure 2:
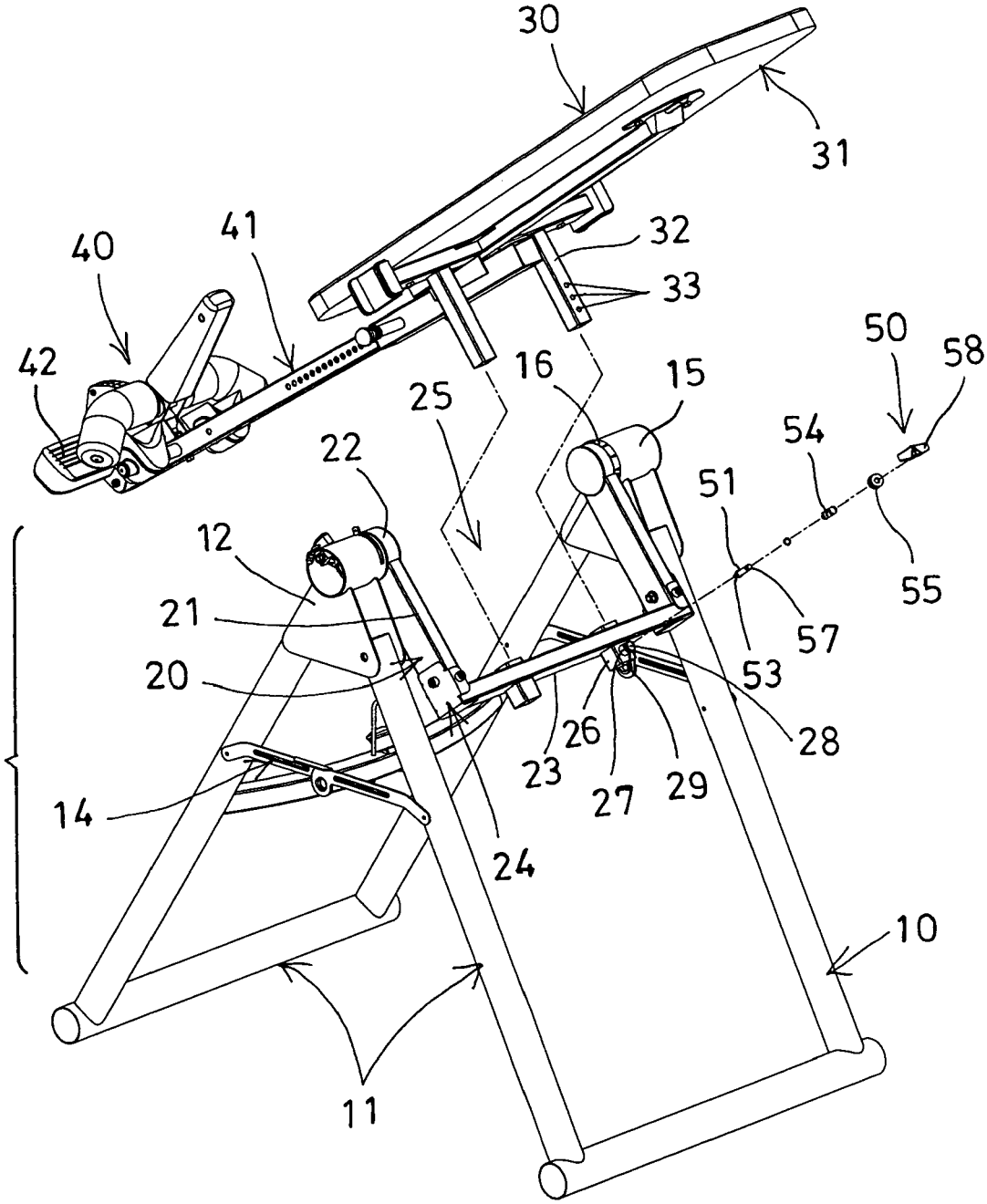
FIG. 2 is a partial exploded view of the tilting inversion exerciser.

Referring to the drawings, and initially to FIGS. 1 and 2, a tilting inversion exerciser in accordance with the present invention comprises a lower supporting stand 10 for pivotally or rotatably supporting a user supporting base or table 30 thereon, and then for supporting a user 8 on the user supporting table 30, the lower supporting stand 10 includes such as two U-shaped frames 11 having upper ends pivotally coupled together with two apex members 12 so as to form a substantially inverted V-shaped and foldable structure. The lower supporting stand 10 includes a bearing support or pivot axle 13 disposed or attached to each of the apex members 12 for pivotally or rotatably supporting or coupling the user supporting table 30.

The lower supporting stand 10 includes one or more, such as two foldable coupler 14 coupled between the frames 11 for allowing the frames 11 of the supporting stand 10 to be folded to a compact folding structure when the foldable coupler 14 is folded, and for allowing the frames 11 of the supporting stand 10 to be stably supported on a working position when the foldable coupler 14 is opened or unfolded to an open position as shown in FIGS. 1-2, 4-5. The lower supporting stand 10 further includes a motor driving means or motor 15 and/or a reduction gearing 16 disposed or attached or secured to the upper ends or the apex members 12 of the lower supporting stand 10 for driving or rotating the user supporting table 30 which will be described hereinafter.

A U-shaped bracket or carrier 20 includes two arms 21 each having one end or upper or first end 22 attached to the pivot axle 13 and/or the motor 15 and/or the reduction gearing 16, or the reduction gearing 16 is coupled between the motor 15 and the first end 22 of the carrier 20 for allowing the carrier 20 to be rotated relative to the lower supporting stand 10 by the motor 15 (FIGS. 4, 5), and a beam or bar 23 attached or secured to the other ends or lower or second ends 24 of the arms 21 for forming a space 25 between the arms 21 and/or the bar 23 (FIGS. 1, 2) and for slidably receiving the user supporting table 30. The carrier 20 further includes one or more (such as two) tubular members 26 attached or secured to the bar 23, or extended or formed on the bar 23, and a sleeve 27 extended or formed on one of the tubular members 26 and having a bore 28 formed therein and having an outer thread 29 formed on the outer peripheral portion of the sleeve 27.

The user supporting table 30 includes a bottom portion 31 having one or more (such as two) poles 32 extended downwardly therefrom and slidably received or engaged in the tubular members 26 of the carrier 20 for stably guiding the user supporting table 30 to slide or to move and to adjust relative to the carrier 20 and the lower supporting stand 10, and the user supporting table 30 further includes one or more orifices 33 formed in or formed along one of the poles 32 for adjustably securing the poles 32 of the user supporting table 30 to the bar 23 and the tubular members 26 of the carrier 20 and for allowing the user supporting table 30 to be easily and quickly and stably adjusted relative to the carrier 20 and the lower supporting stand 10.

The user supporting table 30 further includes an ankle holder 40 adjustably or coupled to the lower portion of the user supporting table 30 with an adjustable extension 41, for detachably securing the ankle portions of the user 8 to the table 30 and for adjustably supporting the users of different lengths or heights, and a foot pedal 42 attached to the ankle holder 40 or the adjustable extension 41 for being stepped by the users 8 and for stably supporting the user 8 on the user supporting table 30. The ankle holder 40 may be operated with various kinds of motorized actuating devices (not shown) which are typical and will not be described in further details.

The tilting inversion exerciser further includes a locking or latching device 50 for adjustably locking or securing the user supporting table 30 to the carrier 20 and for allowing the user supporting table 30 to be easily and quickly and stably adjusted relative to the carrier 20 and the lower supporting stand 10. As shown in FIGS. 1-6, the latching device 50 includes a pin or latch member 51 slidably received or engaged in the bore 28 of the sleeve 27 and having one or inner end or first end or actuating end 52 engaged into either of the orifices 33 of the pole 32 for adjustably locking or securing the pole 32 to the tubular members 26 of the carrier 20 and thus for allowing the user supporting table 30 to be adjustably locked or secured to the carrier 20 and the lower supporting stand 10.

The latch member 51 includes an enlarged peripheral flange or stop 53 extended radially and outwardly therefrom for engaging with the tubular member 26 and for limiting the latch member 51 to slide relative to the tubular member 26 and the carrier 20, and a spring member 54, such as a coil spring member 54 is engaged onto the latch member 51 and engaged with the peripheral stop 53 of the latch member 51 for biasing or forcing the actuating end 52 of the latch member 51 to engage with either of the orifices 33 of the pole 32. A lock nut or cap 55 is attached onto the sleeve 27 and threaded or engaged with the outer thread 29 of the sleeve 27 and engaged with the spring member 54 for retaining the spring member 54 and the latch member 51 in the sleeve 27.

Figure 3:
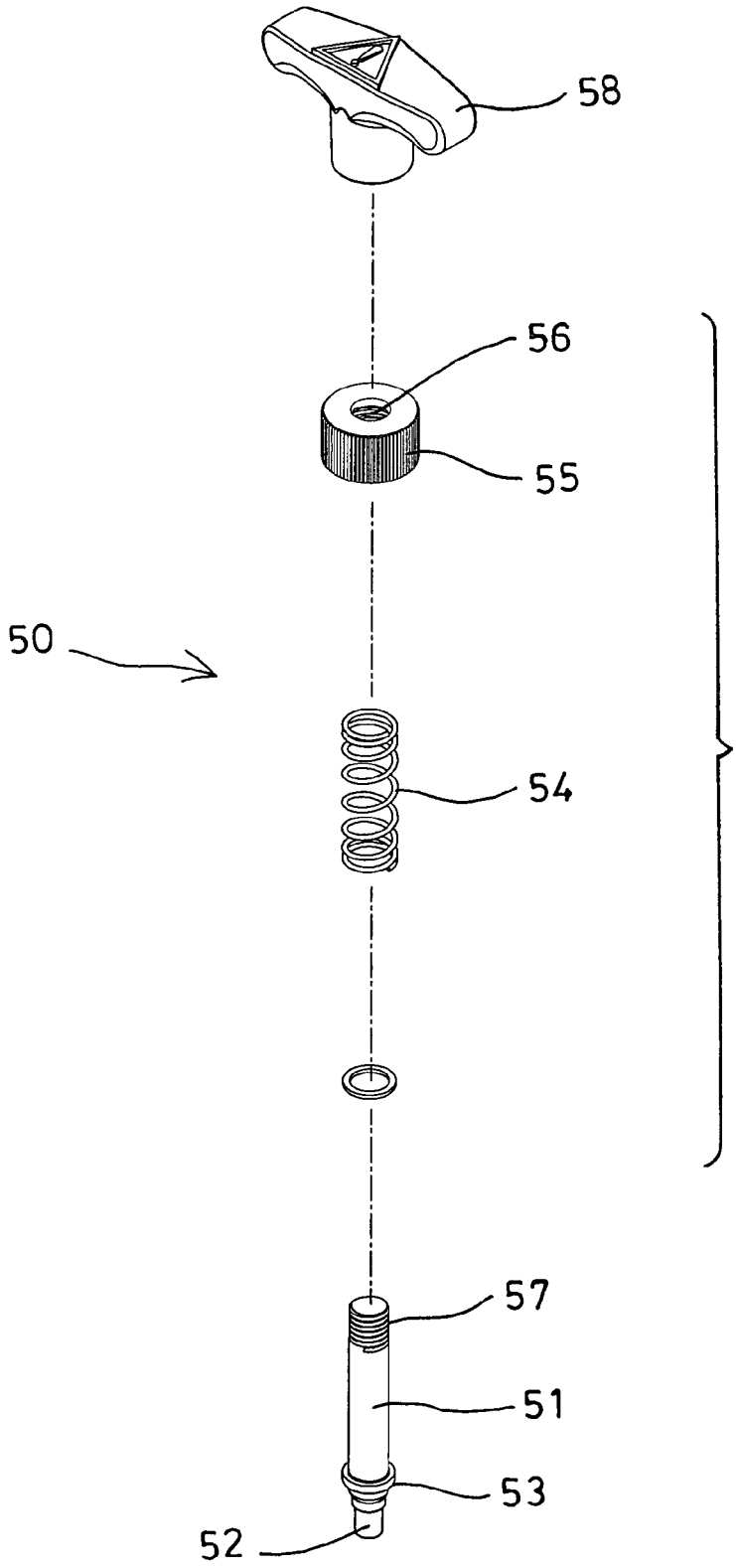
FIG. 3 is another partial exploded view of the tilting inversion exerciser.
Figure 4:
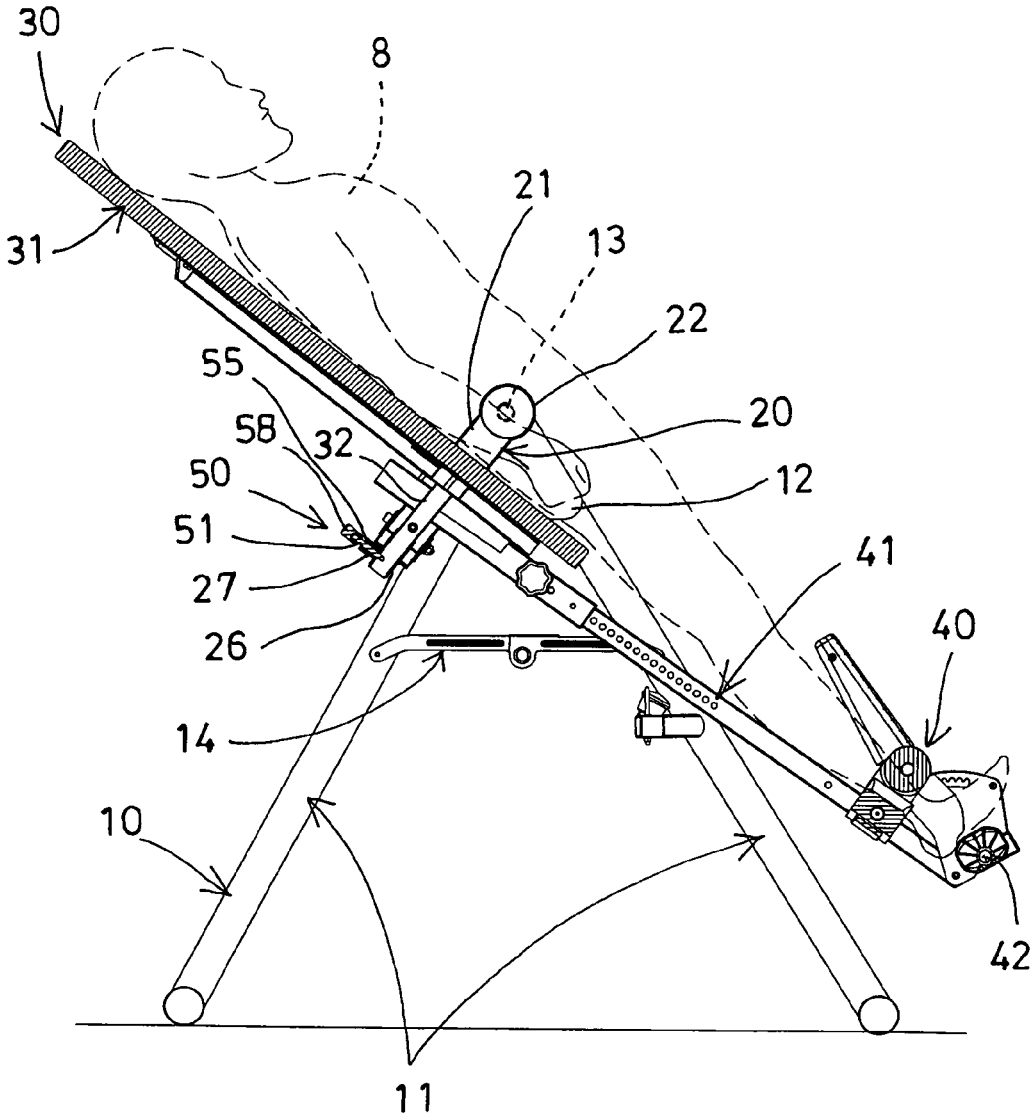
FIG. 4 is a partial cross sectional view taken along lines 4-4 of FIG. 1.
Figure 5:
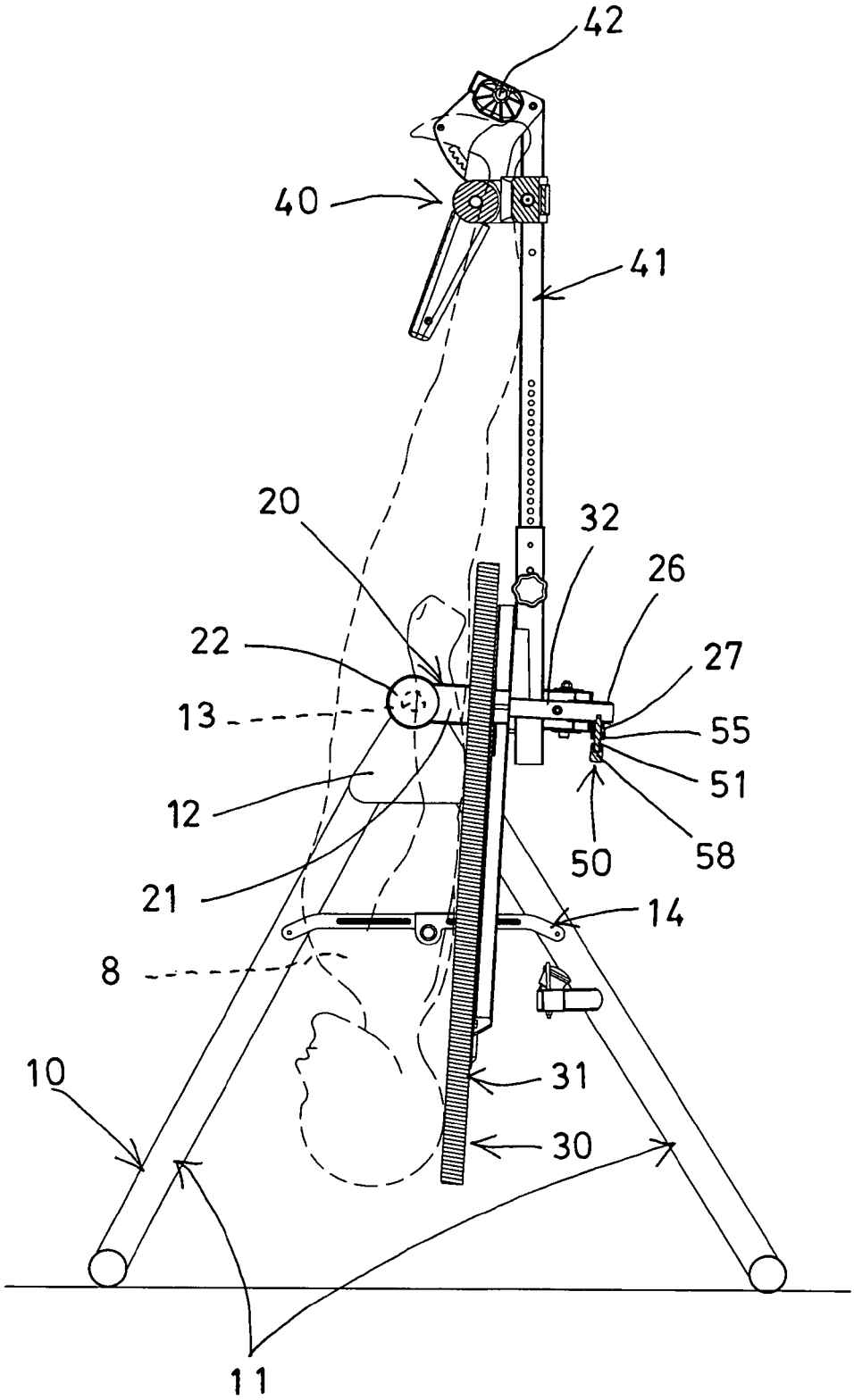
FIG. 5 is another partial cross sectional view similar to FIG. 4 illustrating the operation of the tilting inversion exerciser.
Figure 8:
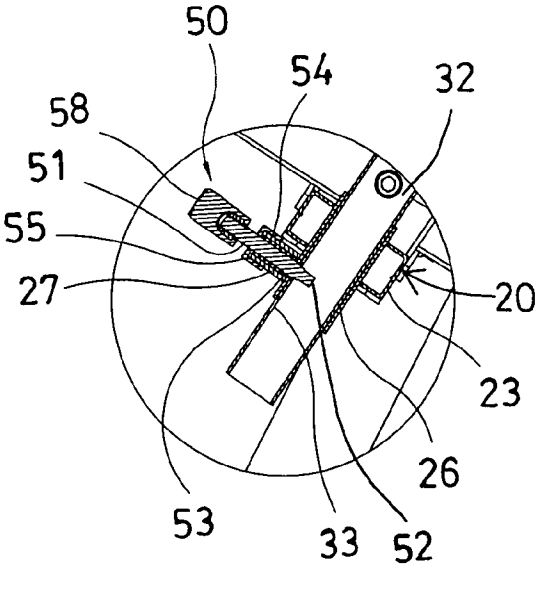
FIGS. 7, 8 are enlarged partial cross sectional views similar to FIG. 6, illustrating the operation of the tilting inversion exerciser.
Figure 7:
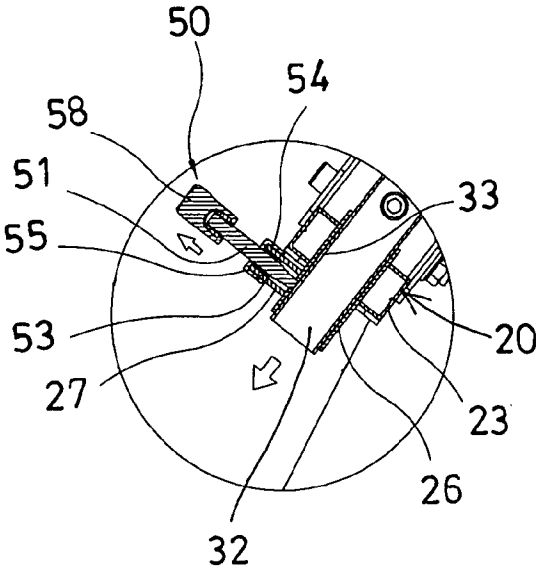
Figure 6:
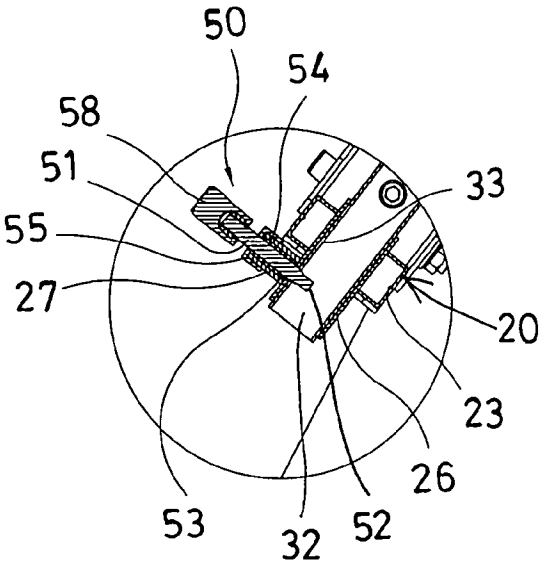
FIG. 6 is an enlarged partial cross sectional view of the tilting inversion exerciser.

As shown in FIG. 3, the cap 55 includes an opening 56 formed therein for slidably receiving the latch member 51 and for allowing the latch member 51 to be partially extended out of the sleeve 27, and the latch member 51 includes an outer thread 57 formed on the outer peripheral portion of the other or second or outer end for engaging with a hand grip or knob 58 which may be used to pull or to move the latch member 51 against the spring member 54 and relative to the tubular member 26 and the carrier 20, and for disengaging the latch member 51 from the pole 32 and thus for allowing the poles 32 and the user supporting table 30 to be moved or adjusted relative to the tubular members 26 and the bar 23 of the carrier 20 (FIGS. 4-8) and thus for allowing the user supporting table 30 to be easily and quickly and stably adjusted relative to the carrier 20 and the lower supporting stand 10.

After the poles 32 have been moved or adjusted relative to the tubular members 26 and the bar 23 of the carrier 20 to the required or predetermined position or location, and/or after the user supporting table 30 has been moved or adjusted relative to the carrier 20 to the required or predetermined position or location, the knob 58 and the latch member 51 may be released, and the spring member 54 may bias or force the actuating end 52 of the latch member 51 to engage with either of the orifices 33 of the pole 32 again and to stably latching or locking the poles 32 of the user supporting table 30 to the bar 23 and the tubular members 26 of the carrier 20 again and thus for allowing the user supporting table 30 to be easily and quickly and stably adjusted relative to the carrier 20 and the lower supporting stand 10.

It is to be noted that the user supporting table 30 may be offset and adjusted or moved relative to the pivot axle 13 and/or the motor 15 and/or the reduction gearing 16 for allowing the center of gravity of both the user supporting table 30 and the user 8 to be adjusted or located closer to or away from the pivot axle 13 and/or the motor 15 and the center of gravity of the stationary supporting stand 10 and thus for allowing the user supporting table 30 and the user 8 to be suitably rotated or driven by the motor 15 and to be stably supported on the stationary supporting stand 10 when the users of different weights or body forms or physiques are supported on the user supporting table 30.

For example, when it is required to support the user of a greater weight or body form or physique on the user supporting table 30, it is preferable that the user supporting table 30 is moved or adjusted toward the bar 23 of the carrier 20 and moved or adjusted away from the pivot axle 13 for allowing both the user supporting table 30 and the user 8 to be located closer to the center of gravity of the supporting stand 10, and thus for allowing both the user supporting table 30 and the user 8 to be stably supported on the supporting stand 10 particularly when the user 8 is conducting the inversion exercises.

On the contrary, when it is required to support the user of a decreased weight or body form or physique on the user supporting table 30, the user supporting table 30 may be moved or adjusted away from the bar 23 of the carrier 20 and moved or adjusted toward the pivot axle 13 for allowing the user supporting table 30 and the user 8 to be located closer to the pivot axle 13 and thus for allowing the user supporting table 30 and the user 8 to be easily rotated or driven by the motor 15.

Accordingly, the tilting inversion exerciser in accordance with the present invention includes a user supporting table pivotally or rotatably attached to a supporting stand with a pivot axle and movable or adjustable relative to the pivot axle of the supporting stand for suitably or adjustably supporting the users of different weights or body forms or physiques.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tilting inversion exerciser for supporting a user comprising:

a supporting stand having at least two U-shaped frames with upper ends pivotally coupled to and including two apex members, said stand includes at least two foldable couplers between said frames, a U-shaped carrier including two arms each having a first end pivotally attached to said apex member and each having a second end, a bar secured to said second ends of said arms for forming a space between said arms and said bar, a user supporting table rotatable attached to said stand and slidably received in said space of said carrier and adjustably secured to said bar of said carrier for adjusting said user supporting table toward and away from said bar of said carrier, and a latching device securing said user supporting table to said bar of said carrier after said user supporting table has been adjusted relative to said bar of said carrier, wherein said carrier includes at least one tubular member extended from said bar, and said user supporting table includes a pole extended downwardly from a bottom portion of said user supporting table for guiding said user supporting table to move and to adjust relative to said carrier, said carrier further includes a sleeve extended from said at least one tubular member, and having a bore formed in said sleeve for slidably receiving said latching device, and wherein said latching device further includes a latch member slidably engaged in said bore of said sleeve and having an actuating end engaged with said pole for adjustably securing said pole to said at least one tubular member of said carrier, and wherein said pole includes a plurality of orifices formed therein for selectively engaging with said actuating end of said latch member, and wherein said latch member includes a peripheral stop extended radially and outwardly therefrom for engaging with said at least one tubular member and for limiting said latch member to slide relative to said at least one tubular member and said carrier, and wherein said latching device further includes a spring member.

2. The tilting inversion exerciser as claimed in claim 1, wherein a motor is attached to said apex member of said supporting stand and coupled to said first end of said arm for driving and rotating said carrier and said user supporting table relative to said supporting stand.

3. The tilting inversion exerciser as claimed in claim 2, wherein a reduction gearing is coupled between said motor and said first end of said arm.

4. The tilting inversion exerciser as claimed in claim 1, wherein said first ends of said arms are each pivotally attached to said apex members with a pivot axle.

5. The tilting inversion exerciser of claim 1, wherein said latching device includes a cap attached to said sleeve and engaged with said spring member for retaining said spring member and said latch member in said sleeve.

6. The tilting inversion exerciser of claim 1, wherein said latch device includes a knob attached to said latch member for pulling said latch member against said spring member and for disengaging said actuating end of said latch member from said pole and for allowing said pole and said user supporting table to be moved and adjusted relative to said at least one tubular member and said bar of said carrier.

* * * * *